US007857617B2

(12) United States Patent
O'Donnell et al.

(10) Patent No.: US 7,857,617 B2
(45) Date of Patent: Dec. 28, 2010

(54) BURNER

(75) Inventors: Michael J. O'Donnell, Avon, OH (US); Richard Cook, North Ridgeville, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 247 days.

(21) Appl. No.: 10/540,695

(22) PCT Filed: Feb. 4, 2005

(86) PCT No.: PCT/US2005/003758

§ 371 (c)(1),
(2), (4) Date: Nov. 3, 2006

(87) PCT Pub. No.: WO2005/078344

PCT Pub. Date: Aug. 25, 2005

(65) Prior Publication Data

US 2008/0182216 A1 Jul. 31, 2008

(51) Int. Cl.
*F23D 3/40* (2006.01)

(52) U.S. Cl. ..... 431/354; 431/329; 431/350; 431/328.7; 126/92 AC; 126/92 R; 122/17.1

(58) Field of Classification Search ..... 431/354, 431/329, 328, 7, 350, 217, 239, 245, 355, 431/326, 351, 170, 154; 122/17.1, 13.01, 122/23, 14.2; 126/92 R, 92 AC, 350.1, 92 B, 126/92 C, 95 R; 48/180.1
See application file for complete search history.

(56) References Cited

U.S. PATENT DOCUMENTS 643,514 A 2/1900 Cowan 2,336,816 A 12/1943 Thompson (Continued)

FOREIGN PATENT DOCUMENTS

BE 627548 1/1963

(Continued)

OTHER PUBLICATIONS

"Low Cost Self-Cleaning Residential Gas Range Oven" Gas Research Institute Final Report ; Jan. 1984-Jun. 1986.

(Continued)

*Primary Examiner*—Steven B McAllister
*Assistant Examiner*—Avinash Savani
(74) *Attorney, Agent, or Firm*—Tarolli, Sundheim, Covell & Tummino LLP

(57) ABSTRACT

A gas burner including a burner body having a lower housing, an inlet conduit and a combustion surface element attached to the lower housing. A diffuser/reflector positioned within the body encourages even distribution and mixing of a combustible gas/air mixture. The diffuser/reflector is preferably of a sheet metal construction and includes a plurality of stamped openings with each of these openings having an overhanging guide plate. The combustion surface element includes a plurality of integrally formed rigidizing ribs and is made from a high temperature steel alloy wire cloth. The inlet conduit is secured directly or indirectly to an access door/bulkhead that is used to close off an access opening formed in a water heater wall through which the burner is installed. In one construction, an air scoop shrouds the inlet conduit and at least partially defines a flow path of primary air, substantially isolated from the combustion chamber.

27 Claims, 9 Drawing Sheets

U.S. PATENT DOCUMENTS

| | | | | | |
|---|---|---|---|---|---|
| 3,084,736 | A | | 4/1963 | Mentel et al. | |
| 3,122,197 | A | * | 2/1964 | Domenick et al. | 431/329 |
| 3,129,749 | A | | 4/1964 | Hönger | |
| 3,161,227 | A | | 12/1964 | Goss et al. | |
| 3,169,572 | A | | 2/1965 | Constance et al. | |
| 3,185,204 | A | * | 5/1965 | Loeb et al. | 431/329 |
| 3,245,458 | A | | 4/1966 | Patrick et al. | |
| 3,303,869 | A | * | 2/1967 | Motoo | 431/329 |
| 3,312,269 | A | * | 4/1967 | Johnson | 431/328 |
| 3,353,583 | A | | 11/1967 | Silhavy et al. | |
| 3,360,028 | A | | 12/1967 | Saponara et al. | |
| 3,363,662 | A | | 1/1968 | Curtis et al. | |
| 3,401,000 | A | | 9/1968 | Spaonara et al. | |
| 3,492,972 | A | | 2/1970 | McLaren | |
| 3,681,002 | A | | 8/1972 | Weller et al. | |
| 3,726,633 | A | | 4/1973 | Vasilakis et al. | |
| 3,733,170 | A | | 5/1973 | Kobayashi et al. | |
| 3,814,573 | A | | 6/1974 | Karlovetz | |
| 3,847,536 | A | * | 11/1974 | Lepage | 431/329 |
| 3,857,670 | A | | 12/1974 | Karlovetz et al. | |
| 3,997,287 | A | * | 12/1976 | Schutte | 431/355 |
| 4,510,890 | A | | 4/1985 | Cowan | |
| 4,519,770 | A | | 5/1985 | Kesselring et al. | |
| 4,608,012 | A | | 8/1986 | Cooper | |
| 4,793,800 | A | | 12/1988 | Vallett et al. | |
| 4,924,816 | A | | 5/1990 | Moore, Jr. et al. | |
| 4,927,355 | A | | 5/1990 | Haire et al. | |
| 5,240,411 | A | | 8/1993 | Abalos | |
| 5,317,992 | A | | 6/1994 | Joyce | |
| 5,340,305 | A | * | 8/1994 | Joyce | 431/7 |
| 5,355,841 | A | | 10/1994 | Moore, Jr. et al. | |
| 5,433,598 | A | | 7/1995 | Joyce | |
| 5,435,716 | A | | 7/1995 | Joyce | |
| 5,511,516 | A | | 4/1996 | Moore, Jr. et al. | |
| 5,520,536 | A | | 5/1996 | Rodgers et al. | |
| 5,575,273 | A | | 11/1996 | Moore, Jr. | |
| 5,632,236 | A | | 5/1997 | Joyce | |
| 5,697,330 | A | | 12/1997 | Yetman et al. | |
| 5,791,298 | A | | 8/1998 | Rodgers | |
| 5,875,739 | A | | 3/1999 | Joyce | |
| 5,915,954 | A | | 6/1999 | Rodgers | |
| 5,984,663 | A | | 11/1999 | Joyce | |
| 6,019,069 | A | | 2/2000 | Joyce | |
| 6,036,480 | A | | 3/2000 | Hughes et al. | |
| 6,439,171 | B1 | | 8/2002 | McCall et al. | |
| 6,446,581 | B1 | | 9/2002 | Carbone et al. | |
| 6,461,149 | B1 | * | 10/2002 | Ahmady | 431/329 |
| 6,659,765 | B1 | * | 12/2003 | Sen-Yu | 431/328 |

FOREIGN PATENT DOCUMENTS

| | | | |
|---|---|---|---|
| FR | 1577719 | | 8/1969 |
| FR | 2651863 | | 3/1991 |
| GB | 741660 | | 12/1955 |
| GB | 2224822 | A | 5/1990 |
| JP | 57164213 | | 10/1982 |
| JP | 60175913 | | 9/1985 |
| JP | 5246536 | | 9/1993 |

OTHER PUBLICATIONS

"Literature Review of Infra-Red Energy Produced With Gas Burners" by D. W. DeWerth—American Gas Association Laboratories.

"A Study of Infra-Red Energy Generated by Radiant Gas Burners" by D. W. DeWerth—American Gas Association Laboratories.

"Some New or Unusual Methods for Heating Water With Gas" by J. C. Griffiths—American Gas Association Laboratories.

The photographs illustrate a heat exchanger construction that has been in public use for more than a year before the filing of the subject application. The photographs show an end of a heat exchanger tube attached to a vestibule panel of a heat exchanger.

* cited by examiner

12'
170
12a'
174
175
175b
22a'
136'
192
190
39a'
39b'
22'
168
184
168b

12'
120
175a
22a'
168
118
164

196
168
180
168a
182
182
32
34a

BURNER

TECHNICAL FIELD

The present invention relates generally to burners and, in particular, to a gas burner that in some applications is capable of operating with low emissions.

BACKGROUND ART

Many types of burners are available for use in gas fired appliances, such as water heaters, room heaters, etc. Recently, the demand for fuel efficient burners and burners that can be configured to produce low emissions has increased especially in view of federal and/or state mandates that have been recently enacted.

DISCLOSURE OF INVENTION

The present invention provides new and improved gas fired burner that can be utilized in various gas fired appliances, such as water heaters, room heaters, cooking appliances and ovens. The burner of the present invention can be used in applications where low emissions are required.

In one embodiment of the invention, a gas burner is disclosed that includes a lower housing, a combustion surface defined by an element attached to the lower housing, and a diffuser/reflector that is positioned below the element. An inlet conduit, preferably including a venturi inlet, communicates a gas/air mixture to the burner body in a region below the diffuser/reflector. In the illustrated embodiment, the diffuser/reflector includes a plurality of openings with each of these openings having an overhanging guide plate. The diffuser/reflector encourages the even distribution of the gas/air mixture in the burner body. In addition, it also acts as a heat shield and reduces the amount of heat transmitted from the combustion surface to the lower housing.

In the preferred and illustrated embodiment, the diffuser/reflector has a somewhat inverted V-shaped configuration. The guide plates are preferably formed by partially stamping through the diffuser/reflector which is preferably made from sheet metal in order to form outwardly extending elements that define the overhanging guide plates. In a more preferred embodiment, the openings are arranged in sets of parallel rows and the diffuser/reflector includes another plurality of openings that is located in an upper region of the diffuser/reflector which do not include associated guide plates.

According to another feature of the invention, the element that defines the combustion surface is radiused and includes a plurality of integrally formed rigidizing ribs. Preferably, the element comprises a screen made from a high temperature steel alloy wire cloth which may have a twill weave of 30×32 mesh.

In the preferred construction, the lower housing includes integrally formed flanges adapted to receive longitudinal edges of the combustion surface defining element. Preferably, the flanges are oriented in a tangential relationship with respect to the combustion surface element.

The lower housing may comprise a channel member having upwardly directed sides. Flanges are preferably defined at upper edges of the sides that receive the combustion surface element. In this disclosed construction, the lower housing includes a pair of endcaps that are secured to opposite ends of the channel member which may also include arcuate flanges for receiving and securing the combustion surface element. In the exemplary embodiment, the inlet conduit extends through an aperture in one of the endcaps. This endcap is captured between a pair of upset ridges formed in the inlet tube. In a more preferred embodiment, the inlet conduit includes a segment that extends into an interior region of the burner body and has a discharge end that is cut at an angle, preferably 45°.

According to another aspect of the invention, the burner is adapted to function within a gas fired heating apparatus, such as a water heater. In this disclosed embodiment, the heating apparatus includes a combustion chamber and a fluid passage communicating with a combustion chamber through which products of combustion are exhausted. The gas burner constructed in accordance with the invention is located within the combustion chamber. According to a feature of the invention, there is also at least one port in the combustion chamber through which secondary combustion air is admitted.

In one illustrated construction, the burner inlet conduit or tube is secured to an access door or bulkhead that is ultimately secured to an exterior wall of the water heater. Combustible gas is injected into the conduit from a source such as a manifold with a metering orifice located upstream of the conduit. The injected gas induces a flow of primary air into the conduit which is drawn from outside the water heater.

Arrangements for mounting a gas manifold and gas orifice in predetermined alignment with an inlet to the burner are also disclosed. In one embodiment, a generally U-shaped manifold mount is used to secure a gas manifold, including a gas orifice, in a predetermined position with respect to an inlet to the burner. In this embodiment, a rodent shield may be used to surround the mount to inhibit rodents and other pests from entering the burner.

In another embodiment, a multi-legged manifold mount is disclosed which includes a plurality of legs that are secured to the mounting surface of the mounting plate. According to a feature of this embodiment, the manifold mount includes a deflecting tab that facilitates assembly of the water heater.

According to another illustrated embodiment, an air scoop shrouds the entrance to the burner inlet conduit (or venturi inlet) and at least partially defines a flow path of primary air that is substantially isolated from the combustion chamber. The flow path of primary air extends from an inlet end of the inlet conduit to a port that communicates with a source of primary air located outside the combustion chamber.

According to another feature of this embodiment, a flow path transition member is located within the combustion chamber and defines a portion of the primary air flow path and is sealingly engageable with the air scoop when the burner is positioned in the combustion chamber. Flange structure forming part of the transition member and air scoop are illustrated which achieve the sealing engagement.

In this embodiment of the invention, the inlet end of the conduit is swaged to a portion of the air scoop. In particular, a wall of the air scoop is captured between upset ridges formed on the inlet tube. The air scoop, in turn, is secured to a bulkhead fitting (also termed a mounting plate or access door) that is also used to close off an opening formed in the heating apparatus through which the burner is installed. The bulkhead also serves to mount a gas orifice through which combustible gas is discharged into the venturi inlet. A gasket concurrently seals the bulkhead fitting to a wall of the heating apparatus and may also serve as the seal between the transition member and the air scoop.

In the illustrated embodiment, the air scoop and transition member are shown as mounted in a water heater. The transition member overlies a port formed in a base plate of the water heater. The air scoop includes an outwardly extending lower lip which is engageable with complementally shaped flanges on the transition member so that as the burner is moved into its installed position within the combustion chamber, a sealing engagement between the components is achieved.

According to another feature of the invention, the mounting plate or bulkhead includes a mounting region defining a mounting surface having a profile that is independent of the overall radius of the mounting plate. By providing this mounting region, the same burner components can be used in water heaters of various diameters, reducing the number of components that must be inventoried. With this aspect of the invention, the same burner body, inlet conduit, air scoop, etc. can be used in many differently sized water heaters. Only the mounting plates to which these components attach, must be specifically configured for a given water tank diameter.

Additional information and a fuller understanding of the invention can be obtained by reading the accompanying detailed description made in connection with the accompanying drawings.

BEST MODE FOR CARRYING OUT THE INVENTION

Figure 1:
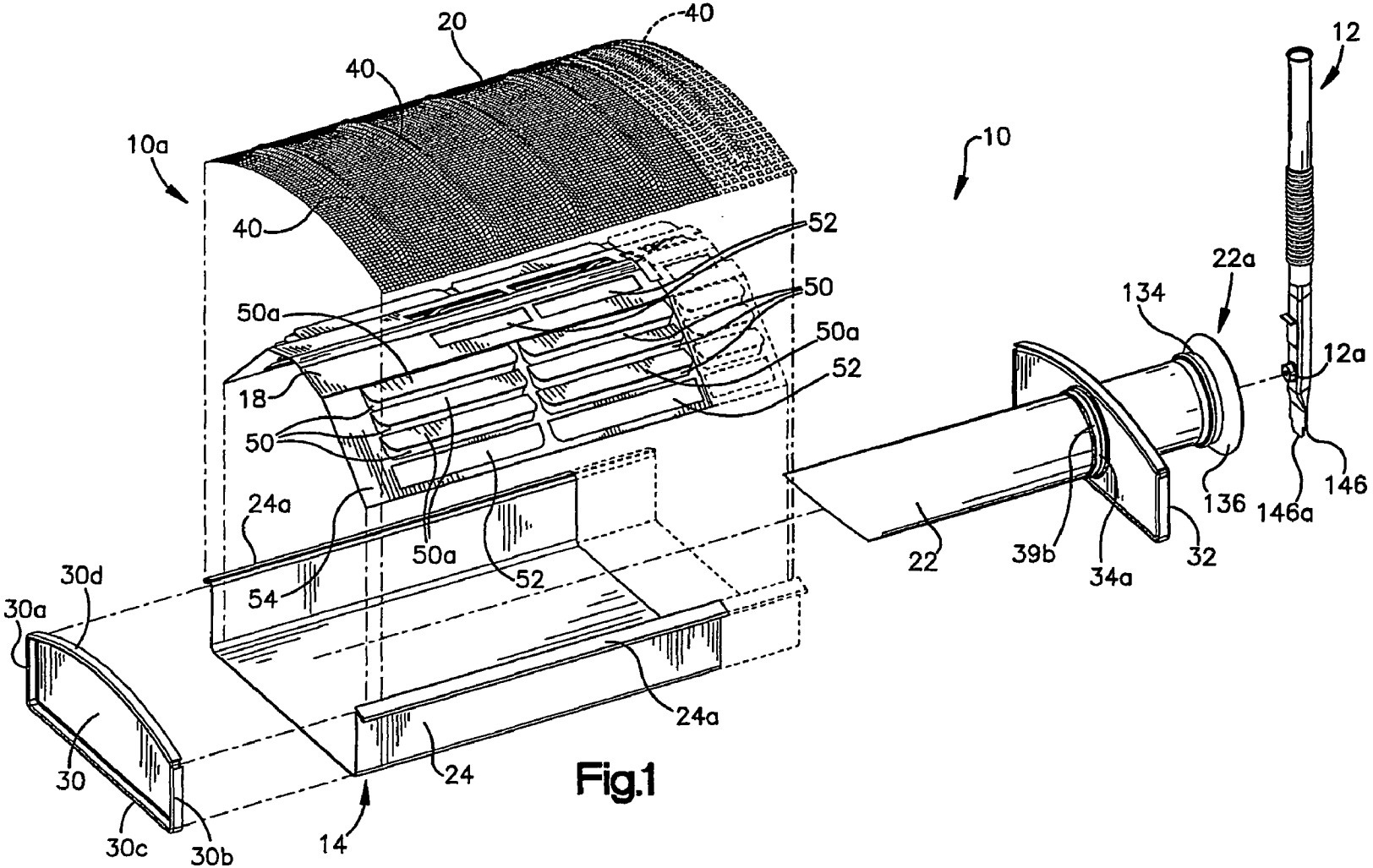
FIG. 1 is an exploded view of a burner constructed in accordance with the preferred embodiment of the invention.

FIG. 1 illustrates a burner 10 constructed in accordance with one preferred embodiment of the invention. In some applications, the disclosed burner can be configured to produce low emissions as compared to more conventional burners. Associated with the burner 10 is a gas manifold 12, which does not form part of the burner, but is one means of providing combustible gas to the burner. In the illustrated embodiment, the gas manifold 12 includes a gas orifice 12*a* through which the combustible gas is discharged. As is known, the discharged gas entrains and mixes with air as the gas enters the burner 10. The entrained air is generally termed primary air.

The burner 10 includes a burner body 10*a* which comprises a lower housing 14, a diffuser/reflector member 18 and a screen-like element 20 defining a combustion surface. A venturi inlet conduit 22 delivers a mixture of gas and primary air into the burner body 10*a*. In the illustrated embodiment, the lower housing 14 is defined by a channel-like member 24 and a pair of flanged endcaps 30, 32. The flanged endcap 30 seals the distal end of the lower housing 14 and includes flanges 30*a*, 30*b*, 30*c* which are crimped to the associated side edges of the channel-like member 24. An upper flange 30*d* receives and is crimped to an associated side edge of the screen member 20. The endcap 32 is similarly constructed but also includes an aperture through which the venturi tube 22 extends. In the preferred construction method, and as will be explained in detail below, the venturi tube 22 is "swaged" into the endcap 32.

The channel-like member 24 includes a pair of upper side flanges 24*a* which are arranged to receive corresponding side edges of the screen member 20. During assembly, the side flanges 24*a* receive and then are crimped to the corresponding side edges of the screen member thus securing the screen member 20 to the lower housing 14. To prevent direct radiant heating of the upper side flanges 24*a*, the flanges are preferably tangentially angled downward to match the arch of the screen member 20.

The diffuser/reflector 18 has a somewhat inverted, V-shaped configuration and includes a plurality of openings through which the gas mixture travels on its way to the combustion surface defined by the screen member 20. In accordance with the invention, the diffuser/reflector 18 enhances the mixing of the gas and air, helps to uniformly distribute the gas/air mixture to the combustion surface 20 and reflects radiant energy away from the interior of the burner.

It should be noted here, that portions of the screen member 20, diffuser/reflector 18 and channel-member 24 are shown in phantom in FIG. 1. The phantom sections illustrate one method by which the thermal output capability of a burner, constructed in accordance with the invention, can be changed. The thermal output capability of a burner is a function of the surface area of the screen member 20. The surface area of the screen member 20 can be varied by changing its longitudinal dimension and hence the longitudinal dimension of the burner body 10*a*. Thus a burner having a longitudinal dimension equal to the solid plus phantom portions shown in FIG. 1, has a larger thermal output capability than a burner having a dimension corresponding to the solid portions shown in FIG. 1. In the case of the diffuser/reflector 18, one method for increasing its dimension is by adding additional rows of openings, as illustrated in FIG. 1.

Figures 1A, 1B:
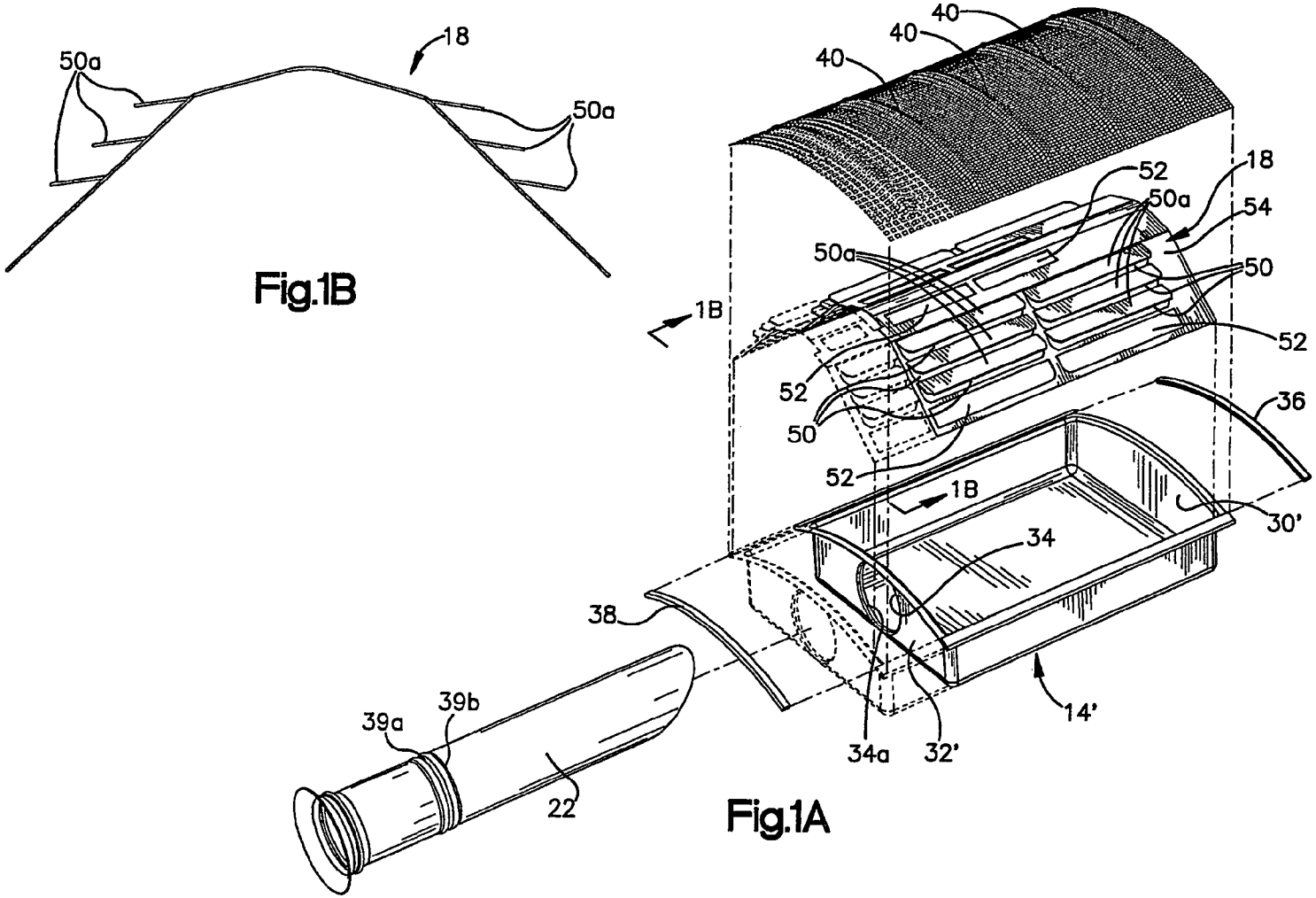
FIG. 1A is an exploded view of an alternate embodiment of the burner shown in FIG. 1.
FIG. 1B is an end view of a diffuser/reflector member forming part of the invention and as seen from the plane indicated by the line 1B-1B in FIG. 1A.

Referring also to FIG. 1A, the lower housing 14 which in FIG. 1 comprises the channel-like member 24 and endcaps 30, 32, can be replaced by a unitary, stamped housing 14'. In this alternate embodiment, separate flange elements 36, 38 are used to crimp corresponding side edges of the screen member 20 to end portions 30', 32' of the stamped lower housing 14'.

As indicated above, in the preferred assembly method, the venturi tube 22 is "swaged" to the endcap 32 (or end portion 32'). FIG. 1A best illustrates this securement method. An axial flange 34*a* is formed around the opening 34 in the endcap 32 (or the end portion 32). The venturi tube 22 is then inserted through the opening 34 to a predetermined depth. While holding the venturi tube 22 and lower housing 14 (or 14') in alignment, a swaging or other known tool, is inserted into the venturi tube 22 and in general expands the portions of the venturi tube on either side of the opening 34, outwardly in order to capture the axial flange 34*a*. In the preferred and illustrated embodiment, the tool forms a pair of circular, upset ridges 39*a*, 39*b*; the axial flange 34*a* is captured between the ridges 39*a*, 39*b*. (As the ridges 39*a*, 39*b* are being formed, the venturi tube material between the ridges may be also expanded in order to tightly engage the flange 34*a*) The assembled components are illustrated in FIG. 1. The disclosed securement method produces a rigid, gas-tight connection between the venturi tube 22 and the endcap 32 (or end portion 32').

According to the preferred embodiment, the discharge end of the venturi tube 22 (the end located within the burner body 10*a*) is cut on an angle. In the illustrated embodiment, the angle is substantially 45°. Cutting the end of the venturi tube 22 at an angle results in a larger cross-section for the venturi tube outlet, as compared to a venturi tube with a straight cut end. Several functional advantages are obtained by cutting the end of the venturi tube at an angle. It has been found that a higher entrainment of primary air is achieved due to less back pressure. This increase in primary aeration provides for improved burner performance. The angled discharged of this venturi tube design also facilitates distribution of the gas/air mixture.

The screen-like member 20 which defines the combustion surface, is preferably radiused (as seen in FIGS. 1 and 1A) and includes a plurality of integrally formed, rigidizing ribs 40. These ribs reduce the flexibility of the screen-like member 20 and inhibit vibration in the screen which could occur during operation of the burner. These vibrations could be manifested as a "tone" and could occur under certain operating conditions such as initial start up of the burner. The screen 20 can be made from various materials but it has been found that a screen made from a high temperature steel alloy wire cloth having a twill weave of 30×32 mesh provides satisfactory results. Wire cloth made from a material sold under the trade name/trademarks INCONEL and NICROFER can be used for the screen member 20.

In the preferred embodiment and as best illustrated in FIGS. 1, 1A and 1B, the diffuser/reflector 18 comprises a sheet metal stamping. A plurality of openings 50 are preferably arranged in sets of parallel rows. In the preferred embodiment, the holes 50 are formed by partially stamping through the material in order to form, outwardly, transversely extending guide plates 50*a* which overhang the openings 50. In the preferred construction, openings 52 without overhanging plates are formed in the center and lower portions of the diffuser/reflector 18. With the disclosed construction, a uniform gas mixture is distributed underneath the combustion surface 20 (defined by the screen member) prior to combustion.

According to a feature of this construction, the shape of the diffuser/reflector 18 along with the transversely extending guide plates 50*a* serve to block radiant energy from the screen and reflect this energy away from the housing 14 (or 14') and venturi tube 22. As a result, the lower housing 14 (or 14') operates at a lower temperature than if the diffuser/reflector 18 were not provided. This lower operating temperature of the housing 14 (or 14') reduces undesirable radiant energy paths. In the preferred and illustrated embodiment and as best seen in FIG. 1B, the guide plates 50*a* are dimensioned and oriented so that an overlapping relationship is established with respect to adjacent rows of guide plates.

Several methods for securing the diffuser/reflector 18 in position can be used. In one preferred embodiment, the diffuser/reflector 18 is spot welded to the channel member 24 (FIG. 1) or the lower housing 14' (FIG. 1A). In another preferred embodiment, the diffuser/reflector 18 is joined or secured to the channel member 24 (or lower housing 14') using a mechanical joining method. An example of such a joining method is illustrated in U.S. Pat. No. 4,831,711. Tooling for performing the joining method disclosed in this patent is sold under the trademark/trade name TOX.

Finally it should be noted that the distal end of the diffuser/reflector 18 i.e., the end secured by the endcap 30, has a flat, non-apertured section 54. It has been found that blocking flow of the gas/air mixture at the extreme distal end of the burner helps produce a more uniform distribution of the fuel air mixture throughout the burner.

Figure 2:
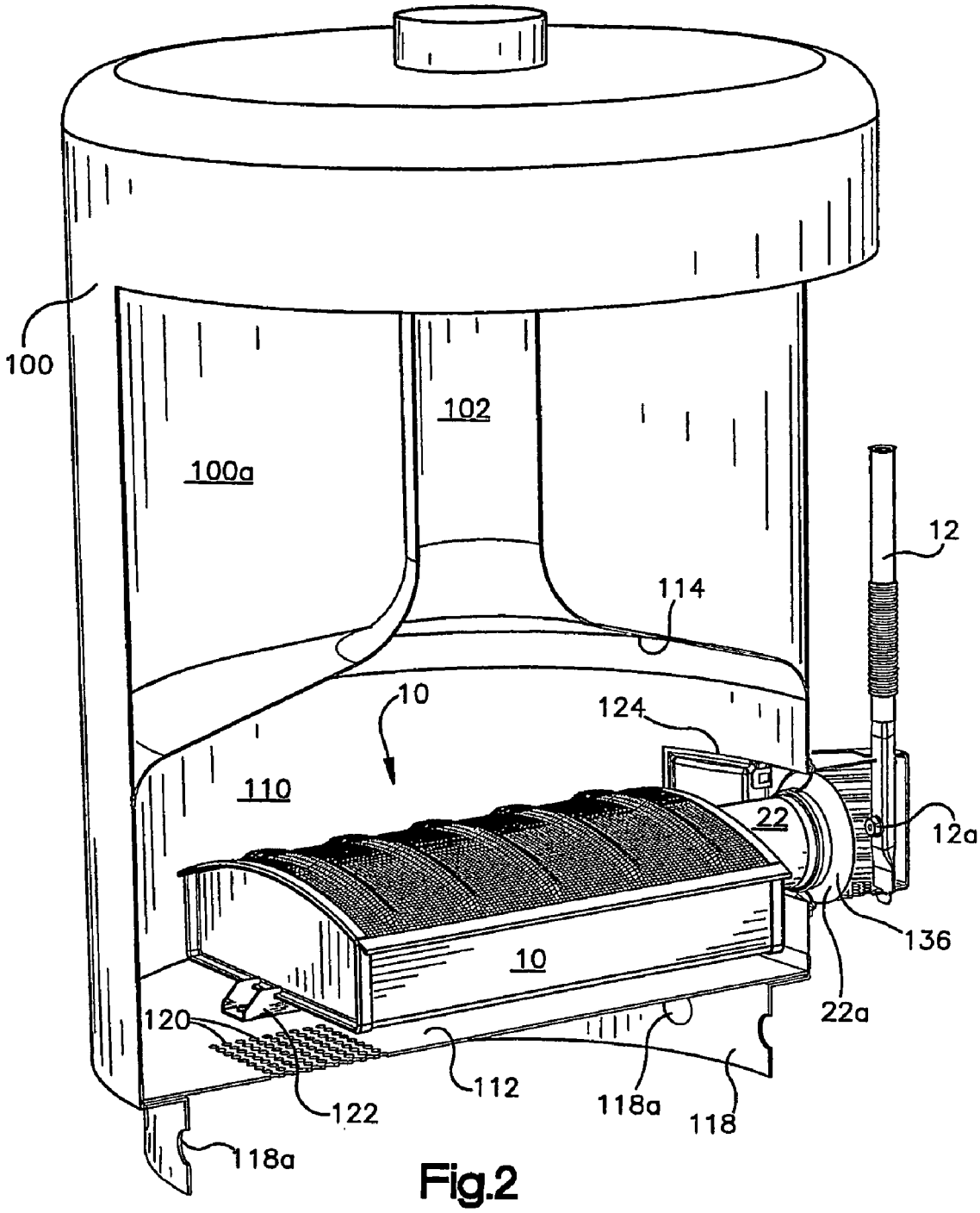
FIG. 2 is a perspective view, in partial cutaway, showing the burner of FIG. 1 mounted within a water heating appliance.
Figure 3:
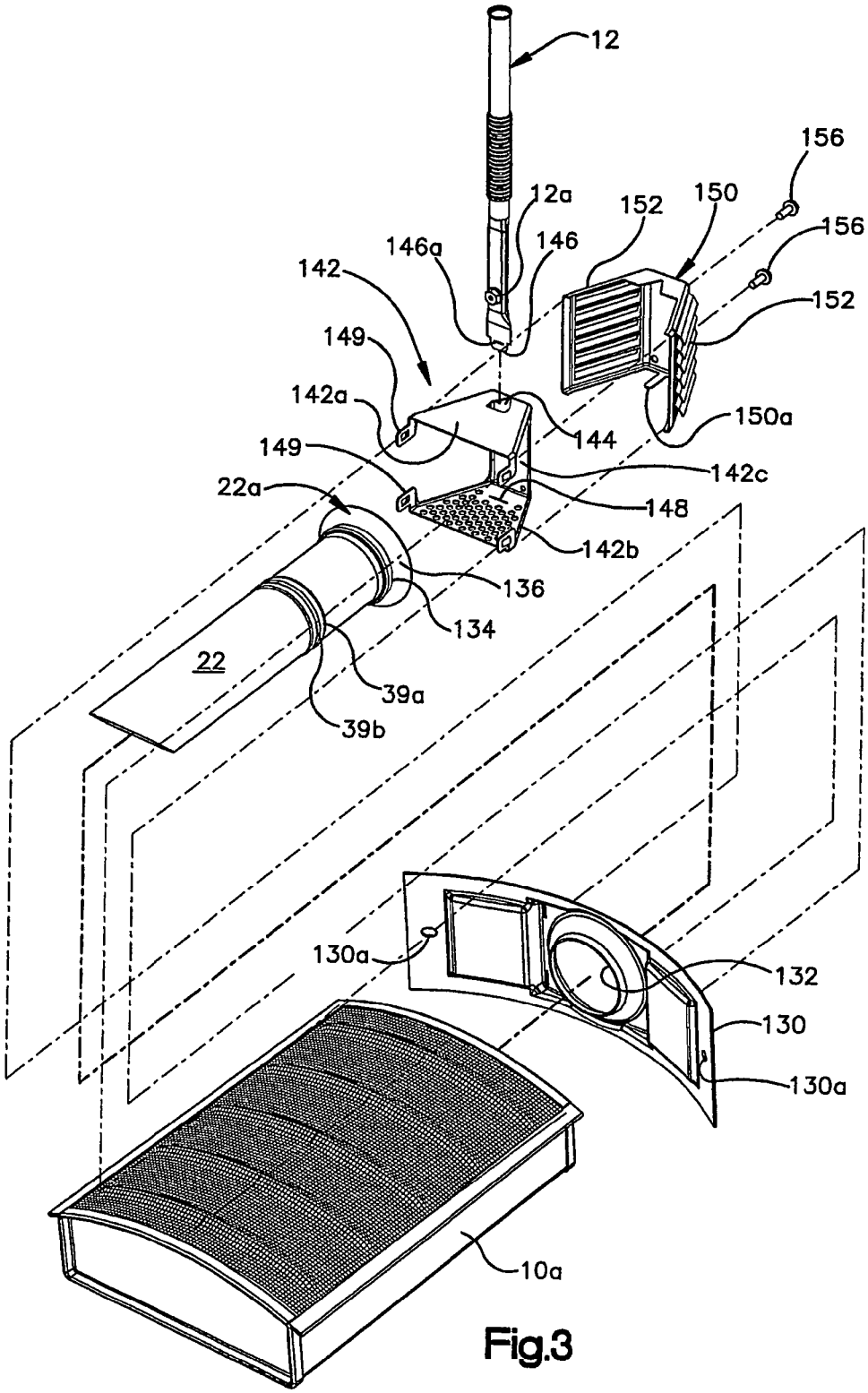
FIG. 3 is another exploded view of the burner showing the details of ancillary components that are used when the burner is mounted within a water heater.

Turning next to FIGS. 2 and 3, the burner of FIG. 1 is shown in a water heating application. It should be noted here, that a water heater is but one example of the type of gas appliance the disclosed burner can be used with. The invention itself, should not be limited to water heating applications. The burner may be used in many other types of gas fired appliances such as room heaters, cooking appliances and ovens.

The water heater itself may be conventional and includes a cylindrical shell or housing 100 which encloses or defines a chamber 100*a* for holding water to be heated. As is also conventional, a flue passage 102 extends through the center of the housing and defines the path for discharging the byproducts of combustion. The flue passage 102 defined by the tank is connected to a flue pipe, chimney or other conduit which conveys the flue gases to a suitable location, generally outside a structure where the water heater is located. The water heater typically includes an ignition device, such as a pilot for igniting the burner. The ignition device which may be conventional does not form part of the invention and is not shown in any of the drawings.

In the illustrated embodiment, the burner is mounted in a cantilever fashion (as seen best in FIG. 2) and may be additionally supported by a bracket 122, if needed. The burner body 10 is suspended within a combustion chamber 110. In the illustrated embodiment, the combustion chamber 110 is defined by a lower portion of a cylindrical shell 100, a base plate 112 that is suitably attached to the bottom of the shell 100 and a dome-like cap 114 which extends radially inwardly from the shell 100 and joins the flue passage 102. The cap 114 also defines the bottom of the water chamber 100*a*.

In the illustrated construction, an annular ring 118 having apertures 118*a* depends downwardly from the base plate and serves as a base for the water heater. In accordance with a feature of this invention, secondary air that is necessary for the proper operation of the burner 10, is admitted into the combustion chamber 110. In the illustrated embodiment, a plurality of apertures 120 are formed in the base plate 112 through which secondary air is admitted. In the illustrated construction, secondary air from outside the water heater travels through the openings 118*a* in the base 118 and into the combustion chamber 110 via the apertures 120. During burner operation, the secondary air admitted into the combustion chamber along with the gas mixture is available for the combustion process. As seen best in FIG. 2, the retaining clip 122 may be used to secure the distal end of the burner 10 to the base plate 112. The clip 122 may be used, if desired, for shipping purposes.

As indicated above, the burner 10 may be suspended within the combustion chamber 110 in a cantilever fashion. However, the present invention also contemplates constructions in which receiver stanchions (not shown) reaching from the base plate 112 up to the bottom of the burner 10 are provided as additional support.

Referring to FIG. 3, details of the components that are used when the burner 10 is mounted within the water heater are illustrated. As is conventional and as seen in FIG. 2, the water heater shell 100 defines a somewhat rectangular opening 124 through which the burner 10 is inserted or accessed. To accommodate conventional water heater constructions, the burner 10 of the present invention includes a means for securing a mounting plate 130 to the venturi tube 22. It should be noted here that the mounting plate 130 may also be referred to as a door or bulkhead fitting. During installation, the mounting plate 130 is secured to and overlies the tank opening 124. In the illustrated embodiment, the mounting plate 130 includes apertures 130*a* through which fasteners (not shown) extend to threadedly engage the tank housing 100. A suitable gasket or gasket material is typically used to seal the mounting plate 130 to the water heater shell 100.

In the preferred construction method, the mounting plate 130 defines an opening 132 through which the venturi tube extends. Preferably, the opening is flared or bell-shaped. A single, upset ridge 134 is formed near the inlet end 22*a* of the venturi tube 22. The inlet end 22*a* is then inserted through the mounting plate opening 132 so that the upset ridge 134 abuts the inside surface surrounding the mounting plate opening 132. In other words, the inlet end 22*a* of the venturi tube 22 would be inserted from the left side of the mounting plate 130 as viewed in FIG. 3. With the ridge 134 abutting the mounting plate and held in predetermined alignment, a suitable tool is used to expand the inlet end of the venturi tube outwardly to form a flare or bell 136 (shown in FIG. 3). The mounting plate 130 is thus captured between the ridge 134 and flare 136. The resulting connection is both rigid and gas-tight. The burner 10 with the mounting plate 130 attached is then inserted through the tank opening 124 until the mounting plate abuts the tank shell 100. Fasteners or other means are then used to secure the mounting plate 130 to the shell 100 thus suspending the burner 10 within the combustion chamber 110.

In the embodiment shown in FIGS. 2 and 3, the inlet end 22*a* (or flare 136) of the venturi tube is located outside the tank shell 100. A source of combustible gas in the form of a gas manifold 12 is positioned upstream of the venturi tube inlet 22*a*. When mounted in position, a gas orifice 12*a* is aligned generally with the axis of the venturi tube 22 and is spaced a predetermined distance from the inlet. As is conventional, gas emitted by the orifice 12*a* enters the inlet 22*a* of the venturi tube 22 along with primary air. As the gas and entrained primary air travel through the venturi tube and through the diffuser/reflector 18 (via openings 50, 52), additional mixing occurs so that a substantially homogenous gas mixture is formed.

Referring to FIG. 3, in the preferred and illustrated embodiment, the gas manifold 12 is held in a predetermined position with respect to the venturi tube inlet 22*a* by a manifold mount 142 which as will be explained, is secured to the mounting plate 130. The manifold mount 142, in the illustrated embodiment, is a sheet metal structure and includes generally V-shaped upper and lower plates 142*a*, 142*b*. The upper and lower plates 142*a*, 142*b* are similarly shaped and are spaced apart by a center support plate 142*c*. The upper plate 142*a* includes an aperture 144 shaped to receive the manifold 12. The lower plate 142*b* is apertured and is generally parallel to the upper plate 142*a*. In the preferred construction, the manifold 12 includes a tab 146 at its lower end that includes a transverse slot 146*a*. The apertured plate 142*b* of the manifold mount 142 includes a slot 148 adapted to receive the tab 146.

The manifold mount 142 includes a plurality of attaching elements 149 by which the manifold mount 142 is secured to the mounting plate 130. Separate fasteners, not shown, or mechanical joining methods, such as the method illustrated in the above-referenced U.S. Pat. No. 4,831,711, can be used to secure the manifold mount 142 to the mounting plate 130. With the present invention, clips, or other structure formed as part of the manifold mount 142, are configured to snap into or engage complementally formed structure on the mounting plate 130 to thereby secure the manifold mount 142 to the plate 130.

In one construction method, the burner 10 with mounting plate attached, is inserted into and then secured to the water heater. The manifold mount 142 may be attached to the mounting plate 130 prior to insertion of the burner into the tank. Alternately, the manifold mount 142 can be attached to the mounting plate 130 after the burner and the mounting plate are secured to the water heater. The gas manifold 12 is then inserted through the aperture 144 in the upper plate 142*a* until the depending tab 146 extends through the slot 148 formed in the lower apertured plate 142*b*. The transverse slot 146*a* in the tab 146 is arranged such that when the manifold tube 12 is fully inserted into the manifold mount 142, the slot 146*a* is located below the bottom surface of the apertured plate 142*b*.

A manifold cover 150 including a locking lug 150*a* is then installed over the manifold mount 142. The manifold cover 150 is shaped to closely fit over the manifold mount and may include louvered side panels 152 defining openings through which primary air can travel. As the cover 150 is installed, the lug 150*a* enters the transverse slot 146*a* of the manifold tube tab 146 thus locking the manifold tube 12 to the manifold mount 142. Suitable fasteners 156 are then used to secure the cover 150 to the center post 142*c* of the manifold mount 142. The present invention thus provides an inexpensive method by which the manifold tube 12 is held in position while providing easy accessibility for service and maintenance. In the illustrated embodiment, the cover 150 for the manifold mount defines downwardly extending louvers. The primary purpose of the cover 150 is to inhibit the entry of rodents, etc. into the venturi tube, while not overly restricting the flow of air into the burner. In any given application, where rodent protection is not required, the louvered side panels 152 of the manifold cover 150 may be omitted.

It should be noted here that the assembly steps described above can be varied substantially depending on the actual water heater design and the methods normally used by the manufacture of the appliance in which the burner is used. The invention should, therefore, not be limited to the order of the steps as discussed above or the steps themselves.

Figure 4:
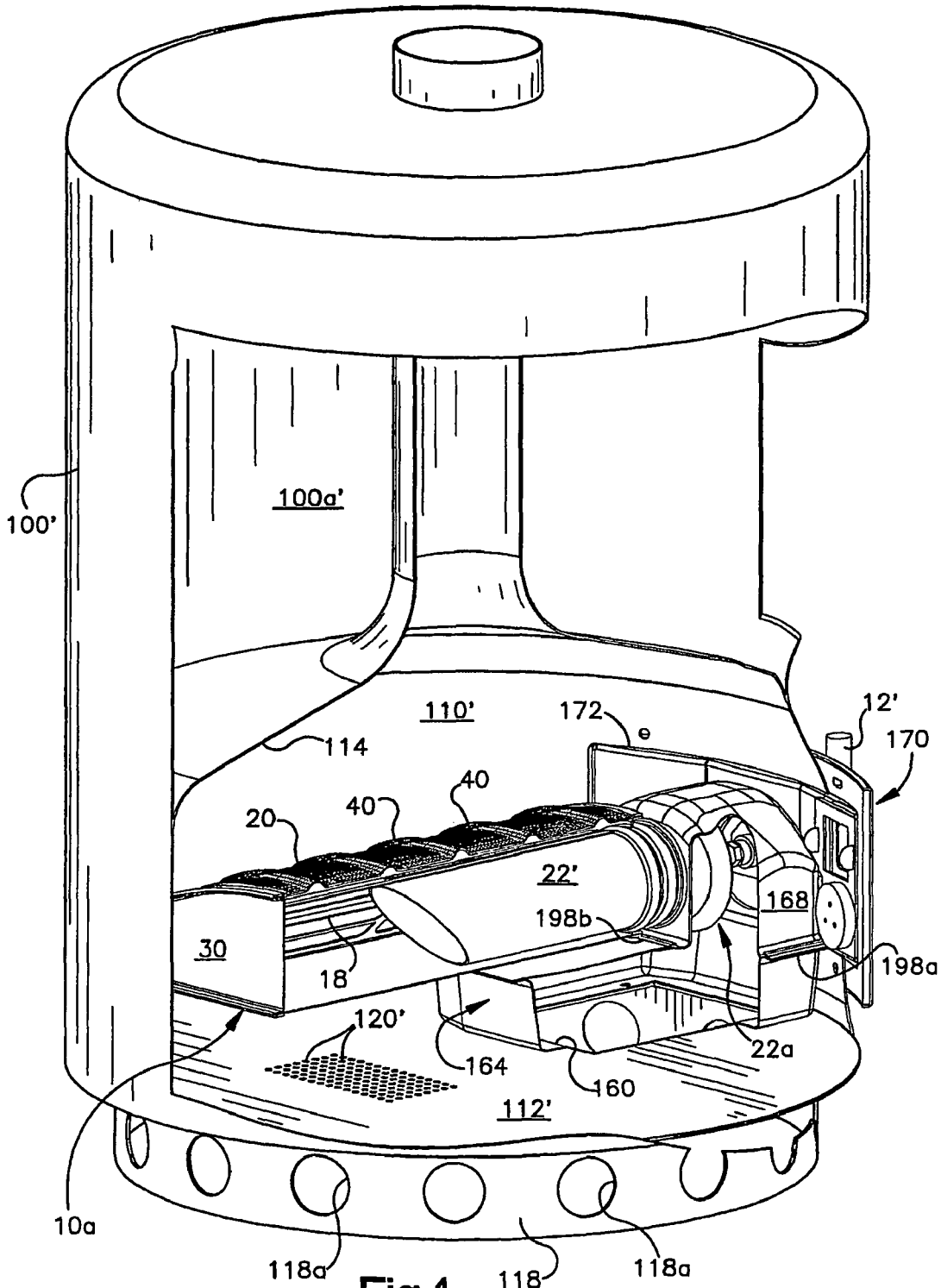
FIG. 4 is a perspective view with portions cutaway, showing an alternate construction of the burner and mounted within a water heater.

FIGS. 4-7 illustrate another embodiment of the burner of the present invention as it would be adapted for use in a water heater of a different configuration. Referring in particular to FIG. 4, the water heater construction is similar to that shown in FIG. 2. The water heater includes a cylindrical shell 100' which at least partially defines a water chamber 100*a*' that contains water to be heated. A combustion chamber 110' is defined at the base of the water heater and is similar to that shown in FIG. 2. The combustion chamber 110' is partially defined by a lower portion of the cylindrical shell 100', a dome shaped cap 114' and a base plate 112'. The base plate 112' of the FIG. 4 configuration differs in that it not only includes a plurality of apertures 120' through which secondary air is admitted, but it also includes at least one opening 160 through which primary air for the burner is admitted. In this configuration, the venturi tube inlet 22*a*' is physically located within the combustion chamber 110', but does not directly communicate with the combustion chamber itself. In particular, the venturi tube inlet 22*a*' receives primary air from below the base plate 112' via the base plate opening 160 and a passage defined by a transition box 164 and a shroud-like air scoop 168 which is slidably engaged to the transition box 164. As a result, a path for primary air is established from outside the water heater by virtue of the holes 118*a* in the base 118 and the enclosed opening 160 in the base plate 112'. This burner configuration is utilized when more control of combustion air is desired. This configuration lends itself to applications where combustion air is ducted from outdoors, i.e., the outside air duct could be connected directly to the opening 160 in the base plate 112' or to the apertures 118*a* in the base 118.

The burner body 10*a* of this embodiment, is the same or similar to that shown in FIGS. 1 and 1A. A venturi tube 22' (shown best in FIG. 5) is utilized in this embodiment that is of a slightly different configuration than the venturi tube 22 shown in FIG. 1.

Figure 6:
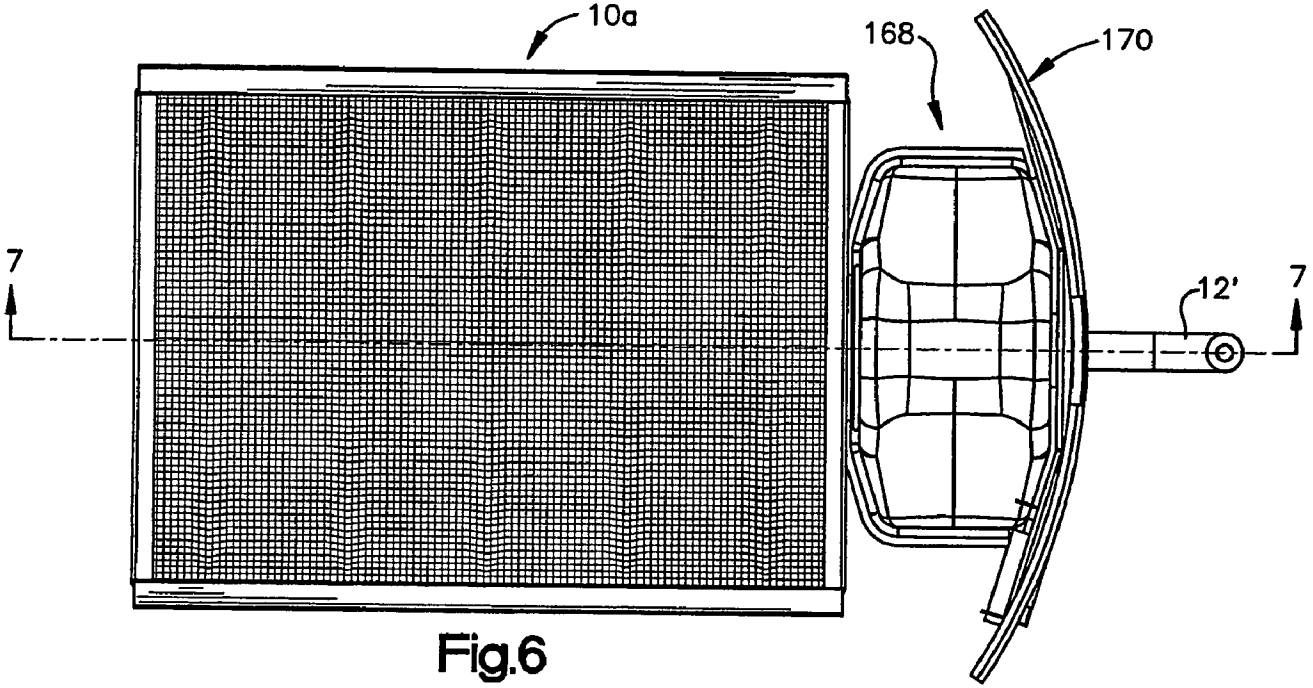
FIG. 6 is a top plan view of the burner shown in FIG. 4.

The assembled burner is shown best in FIG. 6 and includes the burner body 10*a*, the shroud-like air scoop 168 and a bulk head fitting 170 which secures the assembly to the water tank shell 100'. As is conventional, the water tank shell 100' includes a rectangular opening 172 (shown in FIG. 4) through which the assembled burner (the burner body 10*a*, the venturi tube 22', the air scoop 168 and the bulkhead fitting 170) is inserted. The bulk head fitting 170 is slightly larger than the opening 172 and covers the opening 172 after installation. A gasket 174 seals the bulkhead fitting 170 to the tank housing 100'. The gasket 174 inhibits leakage of air from outside the tank into the combustion chamber 110' and visa versa.

Figures 4A, 5, 5A:
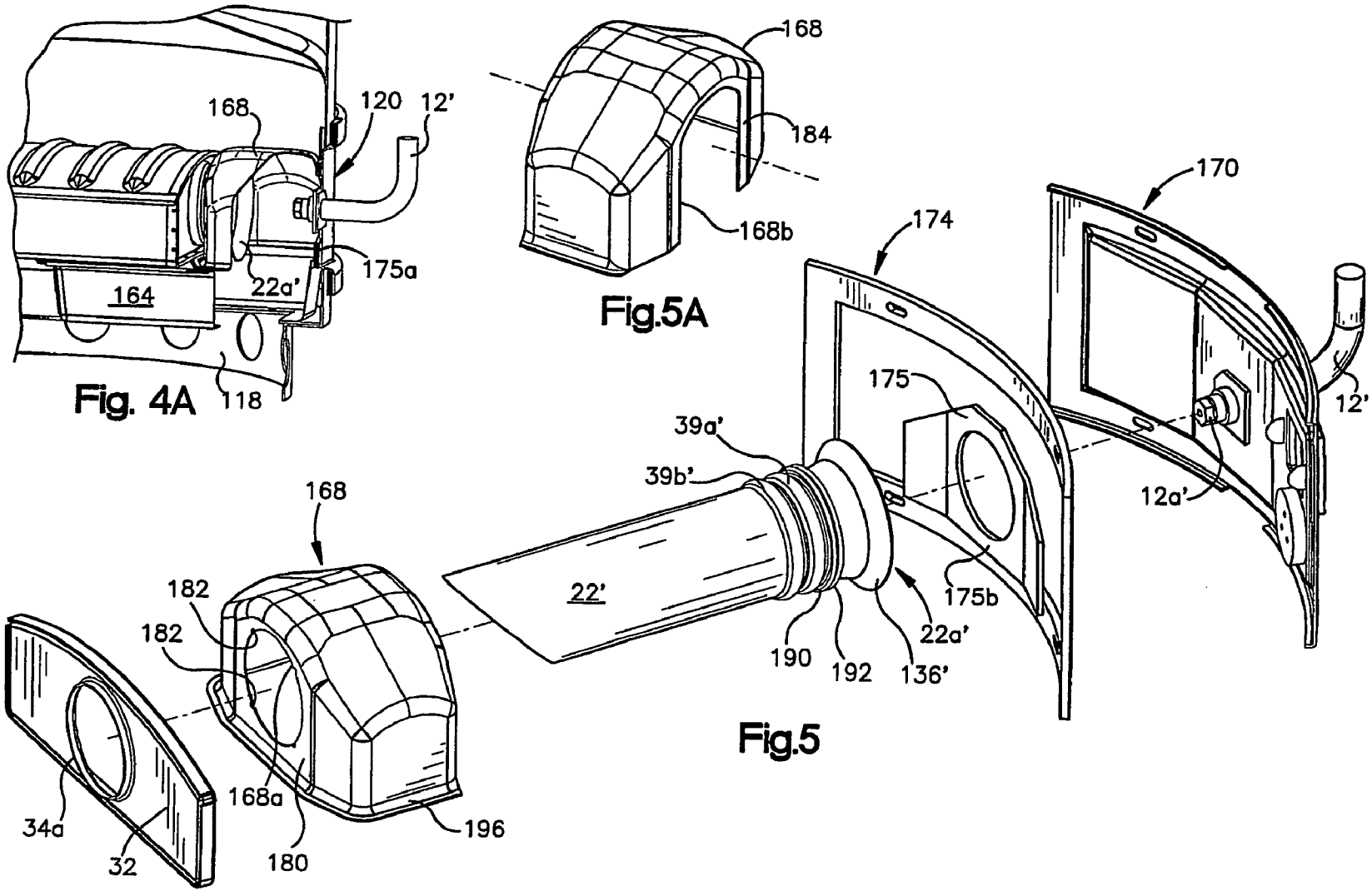
FIG. 4A is a fragmentary perspective view with portions cutaway of the water heater construction shown in FIG. 4.
FIG. 5 is an exploded view of a portion of the burner construction shown in FIG. 4.
FIG. 5A is a perspective view of an air scoop forming part of the present invention.
Figure 7:
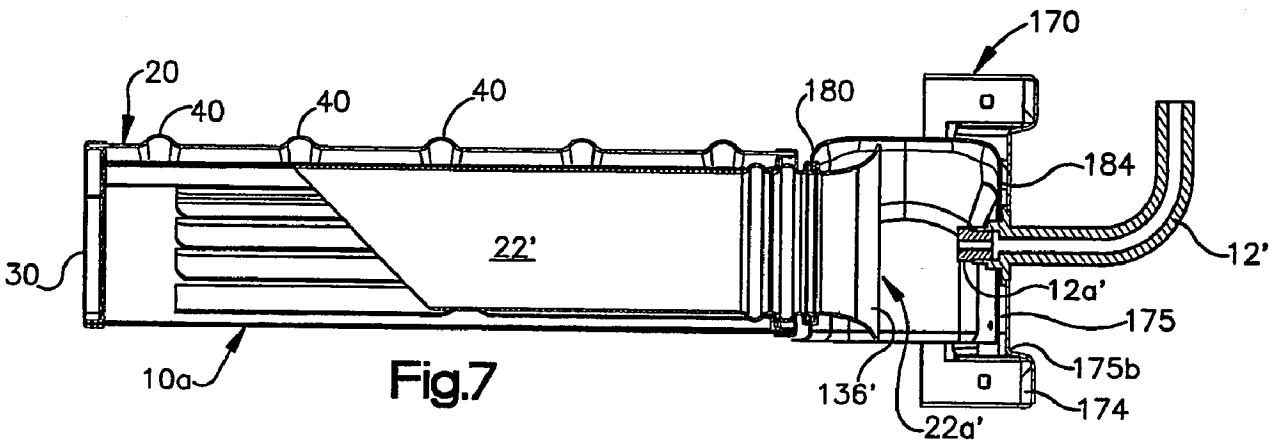
FIG. 7 is a sectional view of the burner as seen from the plane indicated by the line 7-7 in FIG. 6.

The bulkhead fitting 170 receives and mounts the end of a gas delivery pipe 12'. A gas orifice 12*a'* is mounted to the end of the delivery pipe 12'. Once assembled, the orifice 12*a'* is located in axial alignment with the venturi tube 22' and as seen in FIG. 7, is spaced from a flared venturi tube inlet 22*a'*. As seen in FIG. 5, the air scoop 168 is shroud-like in construction and is preferably a sheet metal stamping and includes a pair of aligned openings 168*a*, 168*b*. The opening 168*a* through which the venturi tube 22' extends is shown in FIG. 5; the opening 168*b* through which the gas pipe 12 extends is shown best in FIG. 5A. The venturi tube opening 168*a* is defined in an air scoop side panel 180 and, as seen in FIG. 5, includes a plurality of radial notches 182. An opposite side panel 184 defines the gas pipe opening and is best seen in FIG. 5A.

The inlet end 22*a'* of the venturi tube 22' is secured to the side panel 180 of the air scoop 168. The endcap 32 for the burner housing 10*a* is also secured to the venturi tube 22' as described earlier. To attach the venturi tube 22' to the air scoop 168, the inlet end 22*a'* of the venturi tube 22' with upset ridge 190 already formed, is inserted through the opening 168*a* prior to forming the flare 136'. While being held in position, a conventional tool is used to upset ridge 192 thus captivating the side panel 180 of the air scoop 168 between the ridges 190 and 192. The metal forming pressures used to upset ridge 192 cause some wall material of the venturi tube 22' to enter the notches 182 in the side panel 180 of the air scoop 168. This material inhibits relative rotation between the venturi tube 22' and the air scoop 168. Tooling is then used to expand or flare the end of the venturi tube outwardly to form the flared or belled inlet 136'.

The venturi tube 22' is attached to the burner body 10*a* utilizing the previously described method. In particular, tooling is used to expand the venturi tube wall outwardly to form upset ridges 39*a'*, 39*b'* to capture the axial flange 34*a* forming part of the endcap 32, thus locking the venturi tube to the burner body. Referring also to FIGS. 5A and 7, the opposite side panel 184 of the air scoop 168 is secured to the bulkhead fitting 170 using rivets or other suitable fasteners. An air scoop sealing gasket 175 is sandwiched between the side panel 184 of the air scoop 168 and the bulkhead fitting 170, thus sealing the air scoop side panel 184 to the bulkhead fitting 170.

The assembled burner and bulkhead fitting as seen in FIGS. 6 and 7 is then inserted through the opening 172 in the tank shell 100'. The air scoop 168 is formed with an outwardly extending, bottom lip 196 which extends, as seen in FIG. 5, along three sides of the air scoop 168. As the assembled burner is slid into position, the lip 196 of the air scoop 168 sealingly engages complementally shaped flanges 198*a*, 198*b* formed in the transition box 164. The transition box 164 surrounds the primary air opening 160 in the base plate 112'. After the burner assembly is installed, a primary air path is established from the primary air opening 160 in the base plate 112' to the venturi inlet 22*a'* via the transition box 164 and air scoop 168. The engagement that occurs upon installation between the air scoop 168 and the transition box 164, isolates the primary air path from the combustion zone in the combustion chamber 110'.

As seen best in FIGS. 5 and 7, the gasket 175 is dimensioned so that a lower edge portion 175*a* of the gasket 175 sealingly engages the transition air box 164 when the burner assembly is slid into position to inhibit air from entering the air scoop 168 from the combustion chamber 110'.

Figure 8:
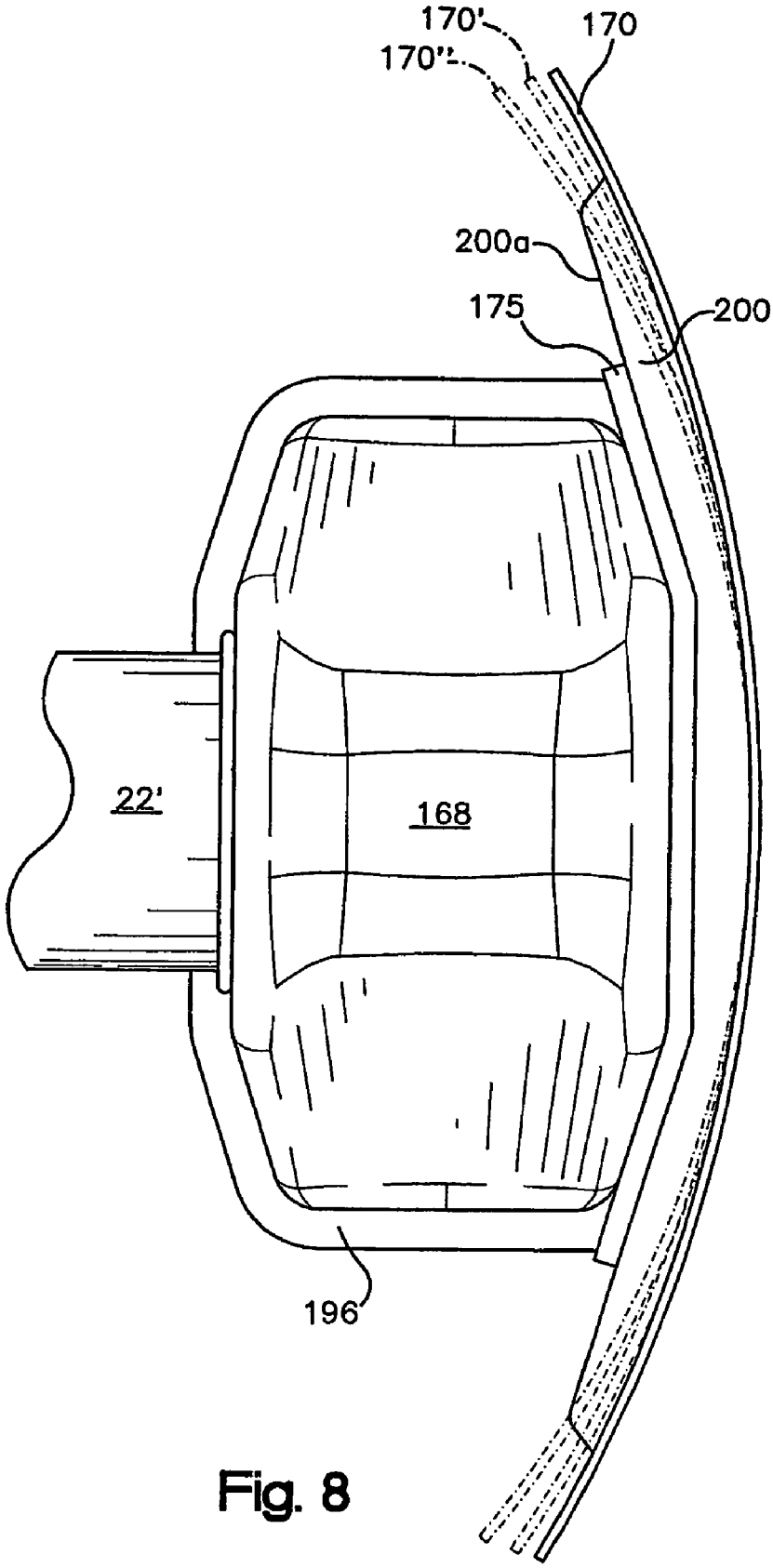
FIG. 8 is a fragmentary top plan view of the burner inlet tube and mounting plate that is shown more fully in FIG. 6; and, FIG. 9 is a perspective view of an alternate arrangement for mounting a gas conduit and gas orifice.

The disclosed burner arrangements are intended to function in water heaters of various diameters. According to a feature of the invention, the mounting plate 130 and the bulkhead fitting 170 each include a constant shaped region to which the burner components are attached which includes a profile when viewed from above, that is independent of the radius of the mounting plate 130 or the bulkhead fitting 170. FIG. 8 illustrates this feature of the invention as used on the bulkhead fitting 170. This Figure illustrates bulkhead fittings of various radii that are designated 170, 170' and 170" (the latter two being in phantom). The bulkheads 170, 170', 170" each have a different radius of curvature to accommodate a water tank wall of a specific diameter.

All of these bulkheads include a recessed region 200 which defines a mounting surface 200*a* for the air scoop 168. As seen in FIG. 8, the gasket 175 is sandwiched between the air scoop 168 and the mounting surface 200*a* of the recessed region 200. As seen in FIG. 8, the profile of the mounting surface 200*a* does not change with changes in the overall radius of curvature for the bulkhead fitting 170. Consequently, the same air scoop 168, gasket 175, and other burner components can be used in water tanks of multiple diameters. Only mounting plates 170 of various curvatures must be provided to which the standard burner components are mounted. In this way, the number of components needed to accommodate water heaters of various sizes are minimized.

Figure 9:
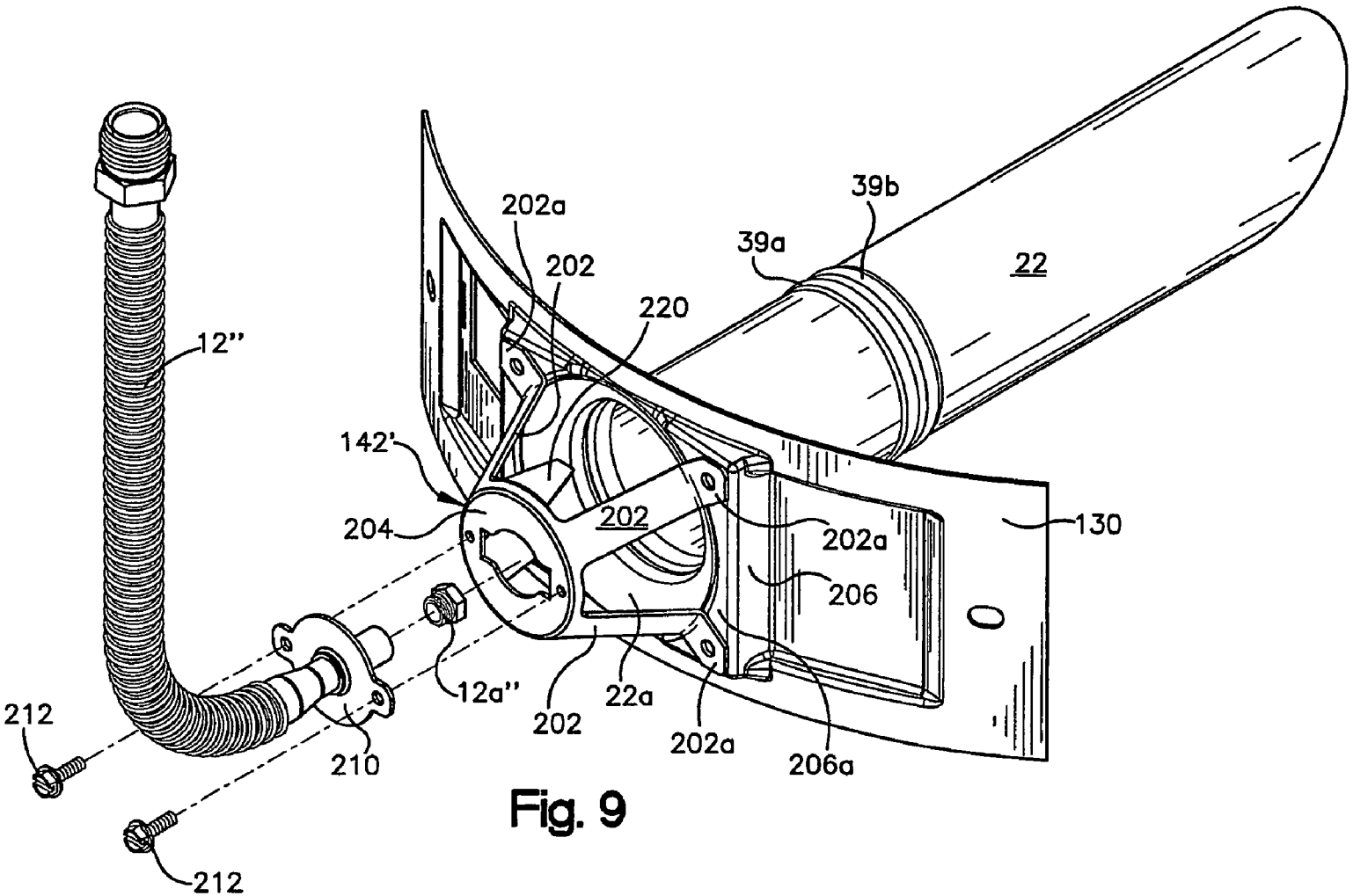

FIG. 9 illustrates another method for attaching a gas manifold 12" in an operative position with respect to the venturi tube inlet 22*a*. The construction illustrated in FIG. 9 is an alternative to the construction discussed in connection with FIG. 3. In this mounting arrangement, a multi-legged manifold mount 142' is utilized. In the preferred construction, the manifold mount 142' includes four legs 202 that extend from a circular seat 204 to spaced mounting locations on the illustrated mounting plate 130. As seen in FIG. 9, the mounting plate includes an outwardly formed recess section 206 which defines a substantially planar mounting surface 206*a* for the inlet end of the venturi tube 22, as well as mounting locations for apertured feet 202*a* integrally formed with the legs 202. The profile of the mounting surface 206*a*, as viewed from above, is independent of the radius of the overall mounting plate 130. As a result, the manifold mount 142' and the inlet end 22*a* of the venturi tube 22 do not have to be altered to accommodate water heater walls/jackets of various diameters.

In the preferred and illustrated embodiment, the manifold 12" includes a mounting plate 210 at its discharge end that is upstream from a gas orifice 12*a*". The mounting plate 210 is attached to the circular seat 204 by fasteners, such as screws 212.

According to a feature of this embodiment, the manifold mount 142' includes a deflecting tab 220 which facilitates assembly of the water heater by deflecting certain water heater components during assembly so that these components do not snag on the manifold seat.

The legs of the manifold mount may be secured to the mounting surface by threaded fasteners, rivets, welding or using other joining methods such as TOX joints (described above).

The present invention thus provides a burner that is adaptable to existing water heater constructions as well as other gas appliances. The burner is intended to be located within a non-sealed combustion chamber of a water heater and in fact relies on secondary air admitted into the combustion chamber to enhance burner operation. In water heater applications, the burner of the present invention can be configured to receive primary air from a region immediately outside the water heater housing or, alternately, to receive its primary air through the water heater base plate.

Although the invention has been described with a certain degree of particularity, it should be noted that those skilled in the art can make various changes to it without departing from the spirit or scope of the invention as hereinafter claimed.

We claim:

1. A gas burner comprising:

a) a burner body including:

i) a lower housing said lower housing having a sidewall;

ii) an element defining a combustion surface attached to said lower housing;

iii) a diffuser positioned below said element;

b) an inlet conduit with an angled discharge end communicating with said burner body through which a gas/air mixture is delivered to said burner body in a region located below said diffuser wherein inlet conduit extends partially into said burner body; and, c) said diffuser including a plurality of openings, each opening having an overhanging guide plate;

d) said diffuser having a somewhat inverted V-shaped configuration, and said openings are arranged in sets of parallel rows located on both sides of said diffuser and said diffuser including a second plurality of openings located in an upper region of said diffuser which do not include associated guide plates located between said openings with said guide plates e) said openings of said parallel rows being oriented to direct said gas/air mixture in a direction generally toward said sidewall, said direction being generally transverse to an axis of said inlet conduit.

2. The burner of claim 1 wherein said diffuser is a sheet metal stamping, and said guide plates are formed by partially stamping through the sheet metal in order to form outwardly extending elements that define the associated overhanging guide plates.

3. A gas burner comprising:

a) a burner body including:

i) a lower housing having sidewalls;

ii) an element defining a combustion surface attached to said lower housing;

an inlet conduit with an angled discharge end communicating with said burner body through which a gas/air mixture is delivered to said burner body in a region located adjacent an inside surface of said combustion surface defining element wherein said inlet conduit extends partially into said burner body; and, c) said combustion surface defining element being radiused and including a plurality of integrally formed rigidizing ribs arranged perpendicularly with respect to said inlet conduit d) said combustion surface defining element having said inside surface exposed to uncombusted gas/air mixture, said gas/air mixture being combusted on said combustion surface defining element and outside said burner body region and e) an inverted, v-shaped sheet metal stamping diffuser having a partially stamped, overhanging guide plates to allow said gas/air mixture to flow radially outwardly toward said side walls.

4. The burner of claim 3 wherein said lower housing includes integrally formed flanges adapted to receive longitudinal edges of said combustion surface defining element by which said combustion surface element is secured, at least partially, to said lower housing.

5. The burner of claim 4 wherein said flanges are oriented in a tangential relationship with respect to said combustion surface defining element.

6. The burner of claim 5 wherein said lower housing comprises a channel member having upwardly directed sides, said flanges being defined at upper edges of said sides and said lower housing further includes a pair of endcaps secured to opposite ends of said channel member.

7. The burner of claim 6 wherein said endcaps include arcuate flanges for receiving and securing side edges of said combustion surface defining element.

8. The burner of claim 6 wherein one of said endcaps includes an aperture through which said inlet conduit extends, said endcap being captured between a pair of upset ridges formed on said inlet tube, whereby said inlet tube is secured to said burner body.

9. The burner of claim 1 wherein said inlet conduit includes a segment that extends into an interior region of said burner body and has a discharge end that is cut on an angle.

10. The burner of claim 9 wherein said angle is substantially 45°.

11. The burner of claim 1 wherein said burner body is substantially rectangular in shape.

12. The gas burner of claim 3 wherein said combustion surface defining element comprises a screen made from a high temperature steel alloy wire cloth having a twill weave of 30×32 mesh.

13. A premix gas burner for use in a water heater, said water heater including a wall at least partially defining a combustion chamber and an access opening in said wall, comprising:

a) a burner body including a lower housing and an element defining a combustion surface that is attached to said lower housing;

b) an inlet conduit with an angled discharge end communicating with said burner body through which a combustible gas and combustion air mixture is delivered to said burner body in a region located below said combustion surface defining element said inlet conduit supplying at least 100% of the combustion air needed for combustion of said combustible gas wherein said inlet conduit extends partially into said burner body; and, c) an access door for closing off said access opening when said burner is in its installed position within said water heater, said access door secured to an inlet end of said inlet conduit;

d) said inlet end of said inlet conduit including an upset ridge that abuts an inside surface surrounding an opening in said door through which said inlet conduit extends and an outwardly extending flare that abuttably engages an outside surface of said door, whereby said door is secured to said inlet conduit and e) an air scoop located in said combustion chamber defining a flow path for primary air and which extends from an inlet end of said inlet conduit and a primary air source located outside of said combustion chamber.

14. The burner of claim 8 wherein said one endcap includes an axial flange around said aperture that is captured between said pair of upset ridges formed on said inlet tube.

15. The gas burner of claim 13 further including mounting structure attached to said door for mounting a gas orifice a spaced distance from said inlet end of said inlet conduit.

16. The gas burner of claim 15 wherein said inlet end of said inlet conduit is secured to said door in a door region having a predetermined profile that is unrelated to the radius of said access opening.

17. The gas burner of claim 13 wherein said inlet conduit is secured to an endcap portion forming part of said burner body, said inlet conduit including a pair of upset ridges located on either side of a wall forming part of said endcap portion.

18. A premix gas burner for use in a water heater, said water heater including a wall at least partially defining a combustion chamber and an access opening in said wall, comprising:

a) a burner body including a lower housing having side walls and an element defining a combustion surface that is attached to said lower housing;

b) an inlet conduit with an angled discharge end communicating with said burner body through which a combustible gas and combustion air mixture is delivered to said burner body in a region located below said combustion surface defining element said inlet conduit supplying substantially all combustion air needed for combustion of said combustible gas wherein said inlet conduit extends partially into said burner body; and, c) a bulkhead/access door for closing off said access opening when said burner is in its installed position within said water heater, said bulkhead/access door secured to an inlet end of said inlet conduit;

d) said inlet end of said inlet conduit being secured to said bulkhead/access door in a region defining a mounting location having a predetermined profile that corresponds to said inlet end of said inlet conduit but that is unrelated to a radius of said access opening and e) an inverted, v-shaped sheet metal stamping diffuser having a partially stamped, overhanging guide plates to allow said gas/air mixture to flow radially outwardly toward said side walls.

19. The gas burner of claim 18 wherein said inlet end of said inlet conduit includes an upset ridge that abuts an inside surface of mounting location region and an outwardly extending flare that abuttably engages an outside surface of said region whereby said bulkhead/access door is secured to said inlet conduit.

20. The gas burner of claim 18 further including mounting structure attached to said mounting location, said mounting structure supporting a gas orifice a spaced distance from said inlet end of said inlet conduit.

21. The gas burner of claim 20 wherein said mounting structure includes a rodent shield.

22. The gas burner of claim 20 wherein said mounting structure comprises an element having a plurality of legs, said legs extending from a seat, distal ends of said legs being secured to said region defining a mounting location on said bulkhead/access door, at spaced locations.

23. The gas burner of claim 22 wherein said element further includes a deflecting tab which facilitates the assembly of a water heater that utilizes said gas burner.

24. The gas burner of claim 18 wherein said combustion chamber includes at least one port through which secondary combustion air is admitted into said combustion chamber.

25. The gas burner of claim 1 wherein said openings of said parallel rows are arranged in first and second sets and direct said gas/air mixture in first and second transverse directions respectively, said first transverse direction being substantially opposite the second transverse direction.

26. The gas burner of claim 1 wherein said lower housing is generally rectangular in shape and has a transverse dimension that is less than its longitudinal dimension, the transverse dimension being transverse to said axis of said inlet conduit.

27. The gas burner of claim 3 wherein said rigidizing ribs are oriented in a direction that is substantially transverse to an axis of said inlet conduit.

* * * * *

UNITED STATES PATENT AND TRADEMARK OFFICE

CERTIFICATE OF CORRECTION

PATENT NO. : 7,857,617 B2
APPLICATION NO. : 10/540695
DATED : December 28, 2010
INVENTOR(S) : Michael J. O'Donnell et al.

It is certified that error appears in the above-identified patent and that said Letters Patent is hereby corrected as shown below:

Column 11, line 62, before "an inlet" insert --b)--

Signed and Sealed this
Fourteenth Day of February, 2012

David J. Kappos

David J. Kappos
*Director of the United States Patent and Trademark Office*